US005836197A

United States Patent [19]

McKee et al.

[11] Patent Number: 5,836,197

[45] Date of Patent: *Nov. 17, 1998

[54] INTEGRAL MACHINE TOOL ASSEMBLIES

[75] Inventors: Ralph E. McKee, Wilmington; James M. Burnett, Mason, both of Ohio

[73] Assignee: McKee Machine Tool Corp., Wilmington, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 767,528

[22] Filed: Dec. 16, 1996

[51] Int. Cl.[6] ..... B21D 41/02; B21D 41/04

[52] U.S. Cl. ..... 72/402; 72/393; 72/370.05; 72/370.08

[58] Field of Search ..... 72/402, 393, 370.05, 72/370.08, 370.04, 370.01

[56] References Cited

U.S. PATENT DOCUMENTS

| | | | |
|---|---|---|---|
| 2,382,359 | 8/1945 | Weightman | 72/402 |
| 4,144,735 | 3/1979 | Rothenberger | 72/393 |
| 4,154,083 | 5/1979 | Rothenberger | 72/393 |
| 4,554,817 | 11/1985 | Dier | 72/393 |
| 4,735,078 | 4/1988 | Wesebaum | 72/393 |
| 4,890,472 | 1/1990 | Rothenberger | 72/393 |
| 4,941,341 | 7/1990 | Kellner | 72/402 |
| 5,022,254 | 6/1991 | Kramer | 72/393 |
| 5,046,349 | 9/1991 | Velte | 72/393 |
| 5,058,467 | 10/1991 | Hoff et al. | 72/393 |
| 5,184,495 | 2/1993 | Chunn et al. | 72/393 |
| 5,243,845 | 9/1993 | Velte | 72/393 |
| 5,379,625 | 1/1995 | Hale | 72/370 |
| 5,517,843 | 5/1996 | Winship | 72/370 |

FOREIGN PATENT DOCUMENTS

| | | | |
|---|---|---|---|
| 1813978 | 7/1970 | Germany | 72/402 |
| 424649 | 4/1974 | U.S.S.R. | 72/402 |

*Primary Examiner*—Daniel C. Crane
*Attorney, Agent, or Firm*—Dinsmore & Shohl LLP

[57] ABSTRACT

An improved machine tool assembly for use with sizing and shaping machines comprising a translating body, a stationary body, and an interconnecting structure is provided. The translating body can be provided in the form of a mandrel or jaw assembly while the stationary body, which cooperates with the translating body to deform a work piece, can be provided in the form of a ring or a housing assembly having a plurality of radially movable fingers. The interconnecting structure joins the translating body and the stationary body so that the same can be removed from the sizing machine as a single unit. The interconnecting structure also has an axial, angular, and/or radial alignment member(s) which maintain the relative alignment between the translating body and the stationary body during installation and/or removal of the machine tool assembly from a sizing machine.

23 Claims, 16 Drawing Sheets

INTEGRAL MACHINE TOOL ASSEMBLIES

FIELD OF THE INVENTION

This invention relates generally to the field of sizing and shaping machines and tools and, more particularly, to improved inside diameter and outside diameter sizing machine tools suitable for shaping the ends of tubes and pipes which include an effectively unitary translating body and stationary body simplifying handling and interchange of such tools.

BACKGROUND OF THE INVENTION

Machine structures for sizing and shaping various types of products (e.g., tubes, pipes and the like) have various constructions in the art. Some machine sizing structures are in the form of hand-held tools which are useful for working tubes having small inside and outside diameters. Larger machine sizing structures are used to shape larger diameter pipes where the force required to expand or reduce the pipe is greater than can be applied by hand. An example of a hand-held machine sizing tool is disclosed in U.S. Pat. No. 5,046,349 to Velte, which describes an expansion tool having a tapered mandrel interconnected with a hand lever via a retraction device. Movement of the hand lever translates the mandrel which, in turn, engages a set of radially expanding wedges. The radially expanding wedges operate against the inside diameter of a tube, expanding this diameter as the mandrel increasingly engages the expanding wedges.

An example of another hand-held expanding tool is disclosed in U.S. Pat. No. 4,735,078 to Wesebaum, which illustrates a tool for expanding work pieces comprising a body with a fixed handle and a pivoting handle. A rigid link member is pivotally connected between a tapered pin and the pivoting handle. Movement of the pivoting handle displaces the pin in the direction of expandable jaws, thereby expanding the jaws. Wesebaum teaches that the rigid link member also provides positive withdrawal of the mandrel from the jaws following a tube expanding operation.

U.S. Pat. No. 5,022,254 to Kramer illustrates a piston-actuated sizing apparatus for expanding a tubular body. The sizing apparatus comprises a cylindrical housing partially enclosing a tapered mandrel, the mandrel being adapted to engage a plurality of expansible blades. The expansible blades are maintained in alignment by the inner edge of a ring which is fixed to the cylindrical housing. Expansion and retraction of the blades is guided by a set of longitudinal channels within the mandrel. A hydraulic piston is utilized to translate the mandrel.

While the above described devices may be suitable for the uses for which they were designed, there is a desire to provide an effectively integral machine tool assembly wherein a translating body is interconnected with a stationary body to form a single integral assembly which sizes and shapes a work piece such that the translating body and the stationary body can be simultaneously removed independent of the mechanism actuating the translating body. Such a feature is especially desirable in large piston-actuated sizing machines where it is desirable to quickly and easily install or remove, for example, a mandrel and matching housing assembly to accommodate a change in the size of the tube or pipe being sized.

Still further, it would be useful to provide an integral machine tool assembly for use in a sizing and/or shaping application wherein a translating body is interconnected with a stationary body to form a single integral assembly such that the axial, radial, and/or angular alignment between the translating body and the stationary body is maintained during installation and/or removal of the mandrel and variable head assembly combination from the machine. Presently, a worker must simultaneously lift and manually maintain the axial, radial, and/or angular alignment among the various parts of an unconnected translating body, such as a mandrel, and stationary body, such as a housing assembly having radially movable fingers and/or jaws, while attempting to insert the combination into a sizing machine. This alignment feature is useful where a predetermined arrangement between the bodies is to be maintained during their installation and/or removal, as is always the case. An effectively integral machine tool assembly which interconnects and automatically maintains the axial, radial and/or angular alignment between a translating body and a stationary body would greatly simplify and expedite interchange of these tools during use.

Thus, there has not previously been available a relatively simple, reliable, and effectively integral machine tool assembly for use in a sizing machine which provides for simultaneous placement and removal of translating stationary body and a stationary body with respect to a sizing machine such that the axial, radial, and/or angular alignment between sub-assemblies can be reliably maintained. As will be described, installation and removal can be further simplified by the provision of a single lifting point for use with mechanical lifting mechanisms such as air hydraulic cylinders, pivot arms and the like.

SUMMARY OF THE INVENTION

It is an object of the present invention to obviate the above-described problems and shortcomings in machine tool assemblies heretofore available in the industry.

It is another object of the present invention to provide an effectively integral quickly interchangeable machine tool assembly which maintains a translating body and stationary body in alignment during installation and/or removal of the assembly from a sizing machine.

It is yet another object of the present invention to provide a quickly interchangeable machine tool assembly which can be placed and/or removed in a direction either transverse with the longitudinal axis of the translating body, so as to facilitate flexibility in the design, manufacture, and use of sizing machines.

It is also an object of the present invention to provide an improved machine tool design which enables the combination of a plurality of separate but structurally related sub-assemblies in an effectively integral manner for facilitating selective installation and removal or interchange with respect to a machine or machine center.

An improved machine tool assembly for use in work piece sizing and shaping machine applications having a translating body, a stationary body, and an interconnecting structure is provided. The translating body is movable in a direction along its longitudinal axis so that it, in cooperation with the stationary body whose longitudinal axis is aligned substantially coaxially with the longitudinal axis of the translating body, can deform a work piece. The interconnecting structure joins the bodies in an effectively integral manner so that the interconnecting structure and the bodies are simultaneously movable as a unit with respect to the sizing machine.

In a preferred arrangement, the translating body is provided in the form of a mandrel and the stationary body has a plurality of radially movable fingers for deforming the work piece. Alternatively, the translating body can be provided with a plurality of radially movable jaws and the stationary body is provided in the form of a ring. The interconnecting structure preferably has an angular alignment member which maintains the angular positions of the bodies relative to each other. The angular alignment member can be provided in the form of a slot and a pin slidably disposed within the slot, or it can preferably comprise a rod and a bore, the rod being slidably disposed within the bore. The angular alignment member can also comprise a tube with a radially extending flange for connecting the tube to the stationary body, the passage of the tube slidably receiving the translating body. A pin disposed within the translating body slidably engages a slot located adjacent to and communicating with the passage, the pin and the slot maintaining the predetermined angular positions of the bodies.

The integral machine tool assembly of the present invention can be incorporated into a work piece sizing machine such that an actuator moves the translating body with respect to the stationary body in a direction along the longitudinal axis of the translating body. The interconnecting structure can further comprise an engagement mechanism for releasably engaging the actuator, wherein the engagement mechanism comprises a locking ball or a plurality of radially biased arms.

BRIEF DESCRIPTION OF THE DRAWINGS

While the specification concludes with claims particularly pointing out and distinctly claiming the present invention, it is believed the same will be better understood from the following description taken in conjunction with accompanying drawings in which:

DETAILED DESCRIPTION OF THE PREFERRED EMBODIMENTS

Figure 1:
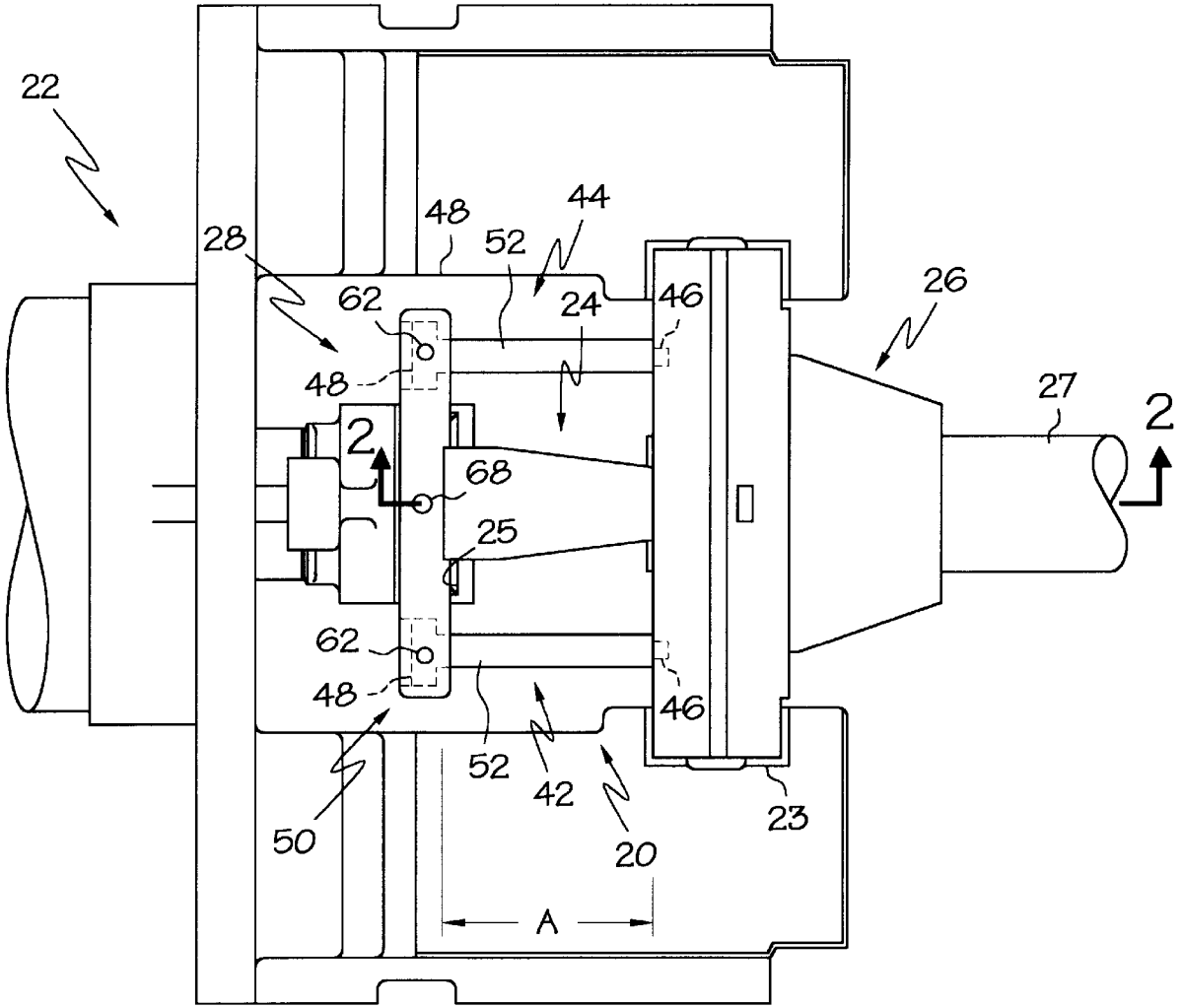
FIG. 1 is a top view of one embodiment of an improved machine tool assembly made in accordance with the present invention and shown engaging a sizing machine, wherein the interconnecting structure comprises two rods, a rod holder, and a mandrel adapter.

Referring now to the drawings in detail wherein like numerals indicate the same elements throughout the views, and wherein numerals having the same last two digits (e.g., 10, 110, 210, 310) connote corresponding parts or assemblies between various embodiments, FIG. 1 illustrates the details of a preferred improved machine tool assembly 20 of the present invention for use with a sizing and/or shaping machine 22 or similar machining and forming Applications. The machine tool assembly 20 comprises a translating body in the form of a mandrel 24, a stationary body in the form of a housing assembly 26 which cooperates with the mandrel 24, and an interconnecting structure 28 for joining together and maintaining the desired alignment between the mandrel 24 and the housing assembly 26. The machine tool assembly 20 preferably engages and is positioned within tool pockets 23 and 25 of a conventional sizing machine 22, as shown in FIG. 1, each pocket being generally similar in shape but different in size. The integral machine tool assemblies of the present invention are thus adapted and sized to engage in a unitary manner conventional sizing machines intended to receive unconnected translating and stationary bodies. While the exemplary embodiments of the present invention shown herein are contemplated for use in combination with a tube forming machine (such as available from McKee Machine Tool and others), it should be readily apparent that it would be equally suitable for use in other sizing and shaping machines. Additionally, the present invention is particularly suited for use in both large sizing and forming machines (i.e., machines requiring large sizing forces to deform the work piece) and hand-held sizing machines, where it is desired, in either case, to provide an effectively integral machine tool assembly in which a translating body and stationary body can be simultaneously removed as a single self-aligned unit from the sizing machine. As used herein, the terms "effectively integral" and "integral" are used to connote an assembly which, while comprising a variety of parts and sub-assemblies, can be installed in, removed from, and otherwise handled and interchanged as a unit while maintaining predetermined alignments and structural arrangements among those parts and sub-assemblies. The machine tool assemblies of the present invention can be formed from hardened tool steels, or other materials may be equally suitable for some portions of the machine tool assembly in particular applications. For example, high strength plastics can be used in portions of the interconnecting structure (e.g. 28) as is known in the art.

Figure 2:
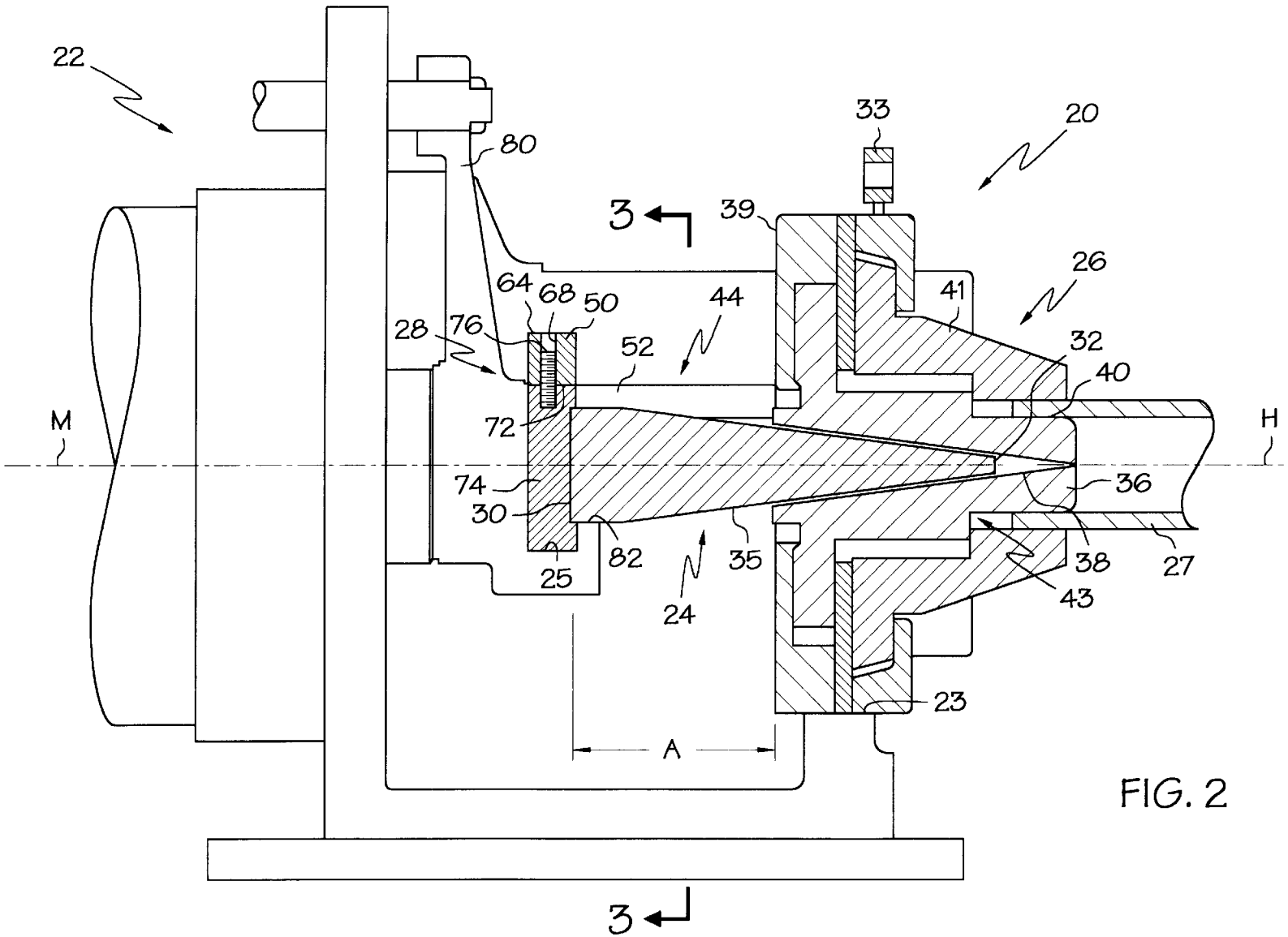
FIG. 2 is a partial cross-sectional side view of the integral machine tool assembly of FIG. 2, taken along line 2—2 thereof and wherein only the machine tool assembly and work piece are shown in cross hatch for clarity.

As most clearly seen in FIG. 2, the mandrel 24 has a longitudinal axis M extending through a first end 30 and a second end 32. Preferably, the mandrel outer surface has a mandrel taper 35 extending radially inward from about first end 30 toward second end 32. The taper 35 of the outer surface of the mandrel 24 can be provided along the entire length of mandrel 24, or, alternatively, along only a portion thereof, as is known in the art.

Figure 3:
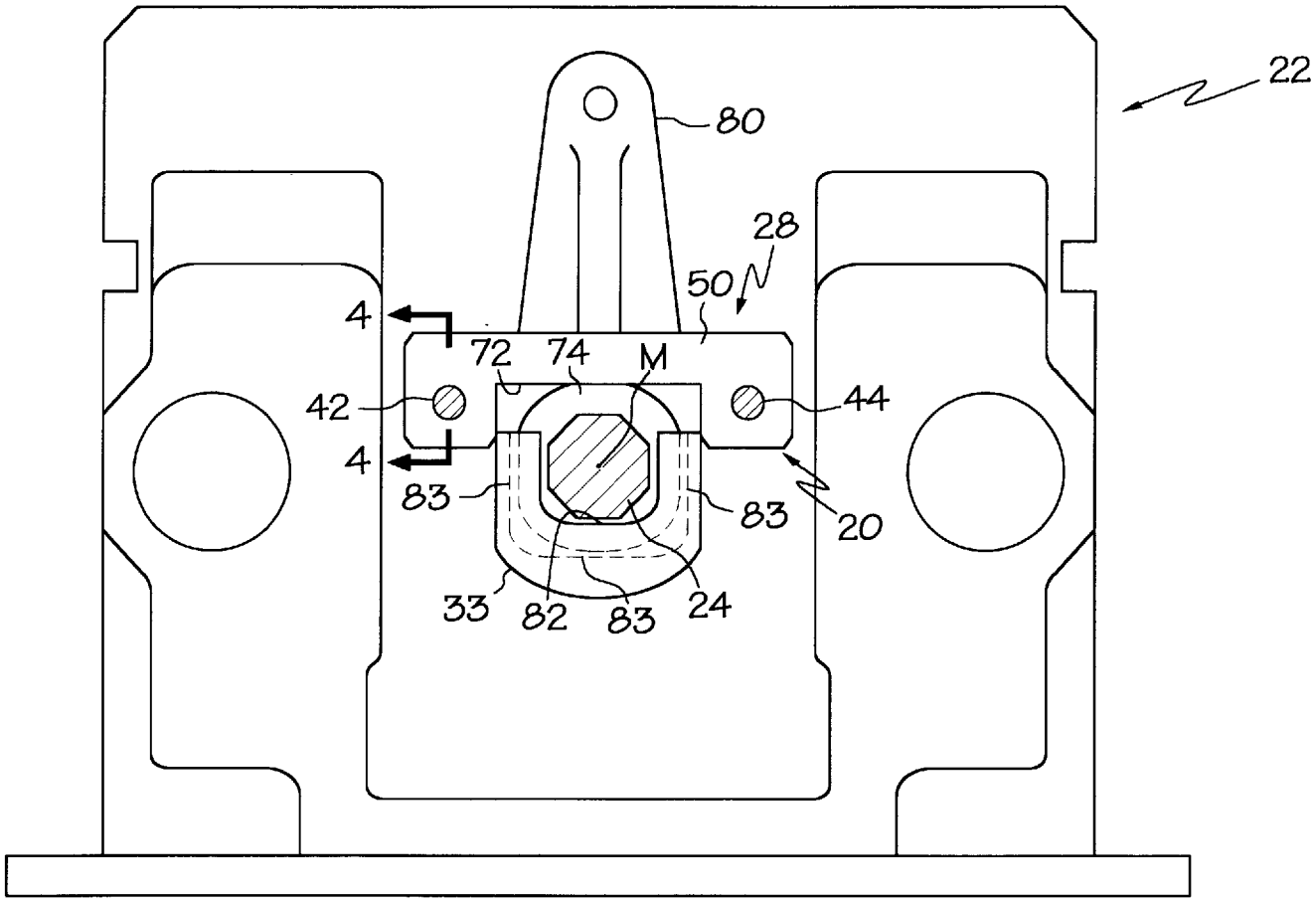
FIG. 3 is a partial cross-sectional front view of the machine tool assembly of FIG. 1, taken along line 3—3 thereof and wherein only the machine tool assembly is shown in cross hatch for clarity.

As shown in FIG. 3, the taper 35 typically comprises a plurality of longitudinally extending flat faces 37 which are adapted to engage the stationary housing assembly 26 such that the mandrel 24 and the housing 26 cooperate in shaping and/or sizing a work piece 27 which, for purposes of discussion herein, is illustrated as a pipe, tube or other hollow object. The housing assembly 26 has a longitudinal axis H which is substantially coaxially aligned with the longitudinal axis M. The housing assembly 26 preferably has a plurality of radially movable fingers 36 disposed adjacent the mandrel 24 for expandingly engaging the work piece 27. Each of the fingers 36 adjacent the mandrel 24 preferably has a finger taper 38 with a plurality of longitudinally extending flat faces (not shown) which cooperate with corresponding flat faces 37 of the mandrel taper 35 as the mandrel 24 is translated toward the housing assembly 26 in use. Particularly, the mandrel taper 35 engages the finger taper 38 as the mandrel 24 is translated in a direction along the longitudinal axis M toward the housing assembly 26, thereby radially expanding the fingers 36 such that a sizing surface 40 of the fingers 36 engages the work piece 27. The housing assembly 26 can also be provided with a set of jaws 41 adjacent the fingers 36 for reducingly engaging the work piece 27, the jaws forming an annulus 43 into which the work piece 27 is inserted, as is known in the art. The housing assembly 24 can also be provided with a lift structure, such as eyelet 33, so that a mechanical lifting device can be used to quickly and easily install and remove the integral machine tool assembly 20 from the sizing machine 22.

In accordance with one aspect of the present invention, an interconnecting structure 28 joins the mandrel 24 and the housing assembly 26 such that mandrel 24 and housing assembly 26 can be simultaneously installed or removed from the sizing machine 22 as a single aligned unit. In other words, the interconnecting structure provides a machine tool assembly of the present invention which, at all times, is movable as a single aligned unit. An integral machine tool assembly of the present invention can also be easily rotated about the longitudinal axes of the stationary and translating bodies in an effectively unitary manner while installed in a sizing machine while advantageously maintaining the axial, angular and/or radial alignment between the bodies, as discussed more fully hereafter. This feature is especially useful where it is desired to perform a second sizing operation on a work piece to further refine its shape or remove surface defects resulting from the first sizing operation.

In addition to interconnecting the mandrel 24 and the housing assembly 26, the interconnecting structure 28 preferably provides one or more alignment members which maintain any desired predetermined axial, radial, and/or angular alignment between the respective parts of the mandrel and the housing and its sub-assemblies during installation and/or removal and interchange of the same from machine 22. As used herein, the phrase "axial alignment" is intended to focus on the axial deviation from a predetermine distance A between the translating body (e.g., first end 30 of the mandrel 24) and the stationary body (e.g., rear face 39 of housing assembly 24) when the translating body is fully retracted from the stationary body, as shown by way of example in FIGS. 1 and 2. The bodies are axially aligned if the distance A can be maintained substantially constant during application of moderate hand pressure to the translating body, the moderate hand pressure simulating the forces associated with installation and/or removal of an integral machine tool of the present invention from a conventional sizing machine. Maintaining the axial alignment between the translating and stationary bodies (i.e., maintaining the distance A substantially constant) can prevent accidental damage to the translating body and/or the stationary body from inadvertent movement of the translating body during the installation and/or removal of a machine tool assembly from the sizing machine.

The phrase "radial alignment" as used herein focuses on the radial deviation between the longitudinal axes of the translating and stationary bodies (e.g. M and H). The translating and stationary bodies are considered to be radially aligned if the respective longitudinal axes can be maintained substantially coaxial (i.e, substantially no significant or meaningful radial deviation) when moderate hand pressure is applied to a translating body positioned at the predetermined distance A.

As used herein, the phrase "angular alignment" focuses on the deviation from a predetermined desirable angular position of the translating body about its longitudinal axis (e.g., M) relative to a predetermined angular position of the stationary body about its longitudinal axis (e.g. H), wherein the phrase "angular position" refers to a predetermined rotational position of the body about its longitudinal axis in a plane perpendicular to the longitudinal axis. The bodies are considered to be angularly aligned if the respective, predetermined desired angular positions of the translating body and the stationary body about their respective longitudinal axes can be maintained substantially constant during application of moderate hand pressure to the translating body. Maintaining the angular and radial alignments between the translating and stationary bodies can be especially desirable where, for example, the flat faces of the mandrel 24 of the machine tool assembly 20 must align with the corresponding flat faces of the radially movable fingers 36 of the housing assembly 26 so that the mandrel 24 can slidably engage the same during operation.

As generally shown in FIGS. 1 to 3, the interconnecting structure 28 of integral machine tool assembly 20 preferably comprises stationary first and second rods 42 and 44, each of which have a threaded end 46 for threadably engaging the rear face 39 of the housing assembly 26 and a free end 48 disposed opposite the threaded end 46. Extending between the threaded end 46 and a free end 48 is a rod body 52. As seen best in FIG. 3, the first rod 42 and second rod 44 are preferably disposed above and spaced sufficiently on either side of the longitudinal axis M such that tool holder 80 of the sizing machine 22 can pass between the rods as it advances the rod holder 50, the mandrel adapter 74, and the mandrel 24 toward the housing assembly 26.

Figure 4:
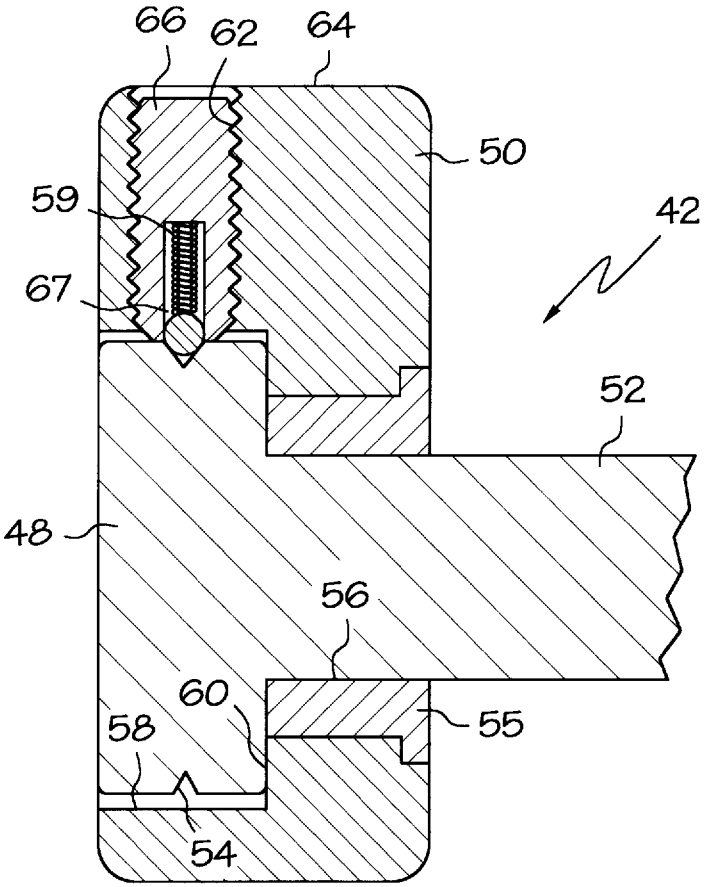
FIG. 4 is a partial cross-sectional side view of a rod holder and rod of the machine tool assembly of FIG. 3, taken along line 4—4 thereof.

Referring now to FIG. 4, the rod holder 50 has, for each rod (e.g., 42 and 44), an end bore 58 for slidably receiving the free end 48 of each rod and a bushing 55 with a bushing hole 56 for slidably receiving the rod body 52. The bushing 55 is preferably formed from a soft metal alloy, such as bronze, so that the rod body 52 can easily slide within bushing hole 56. The bushing hole 56 is preferably disposed adjacent to and in communication with the end bore 58 and has an inside diameter which is less than the inside diameter of the end bore 58 so that an end wall 60 is formed therebetween. The end wall 60 preferably positively engages the free end 48 of each rod during retraction of the mandrel 24, thereby establishing a predetermined mandrel stroke and preventing removal of the mandrel 24 from the integral machine tool assembly 20.

The rod holder 50 further preferably has a threaded pin hole 62 which extends between the holder upper surface 64 and end bore 58. A pin 66 having an alignment ball 67 biased by a spring 59 is threadably disposed within each pin hole 62 so that it can engage a groove 54 disposed on the free end 48 of each rod 42 and 44 when the mandrel 24 is fully retracted (i.e., when the free end 48 engages end wall 60). The engagement of the ball 67 with the groove 54 of each rod provides an axial alignment member which substantially maintains a predetermined distance A between the mandrel 24 and housing assembly 26 during handling, shipping, installation and/or removal of the machine tool 20 from the machine 22. Also, the arrangement of the first and second rods 42 and 44 in combination with the rod holder 50 provides a radial and angular alignment member which prevents relative radial and angular movement between the mandrel 24 and the housing assembly 26.

While the above-described pin, groove, and rod arrangement is preferred, it is contemplated that other arrangements are equally suitable for providing an axial, angular, or radial alignment member(s). For example, it may be desirable to provide additional rods or to place the groove 54 on the rod body 52. Alternatively, it may be further desirable to incorporate more than one groove 52 such that multiple axial alignment distances A are provided. Preferably, however, the pin 66 and groove 54 are positioned so that the predetermined distance A between the first end 30 of the mandrel 24 and the rear face 39 of the housing assembly 26 is between about 4.5 and 6.5 inches, and, more preferably, about 5.5 inches so that the integral machine tool assembly 20 is interchangeable with conventional tube sizing machines.

As best seen in FIGS. 1 and 2, the rod holder 50 also preferably has a bolt hole 68 disposed between the pin holes 62 which extends between the upper surface 64 and the lower surface 72. A bolt 76, or similar fastening device, is disposed within the bolt hole 68 and threadably engages the mandrel adapter 74 which is located adjacent the lower surface 72. The mandrel adapter 74, which is part of the interconnecting structure 28 in a preferred arrangement, is connected to the mandrel 24, such as by an interference fit, welding, adhesives, or other mechanical attachment means. Preferably, the mandrel adapter 74 engages a portion of the pocket 25 of the machine tool holder 80 during use, as shown in FIGS. 2 and 3, such that translation of the tool holder 80 of the sizing machine 22 will also translate the mandrel adapter 74, the mandrel 24, and the rod holder 50, as the latter two structures are connected to the mandrel adapter 74. Adjacent the pocket 25 is a mandrel notch 82 which is preferably disposed vertically above and axially forward of (i.e., closest to the housing assembly 26) the pocket 25 so as to aid in aligning and supporting the mandrel 24. Both the pocket 25 and the mandrel notch 82 are preferably substantially U-shaped in cross-section having flat portions 83 on each of their sides and base, as shown in FIG. 3, wherein the flat portions 83 of the pocket 25 have been labeled by way of example. The flat portions 83 provide surfaces for locating the mandrel 24 and the mandrel adapter 74 within the pocket 25 and notch 82 and can accommodate installation tolerances and other factors which affect alignment of the mandrel adapter and the mandrel within the pockets and notch, respectively.

Figure 5:
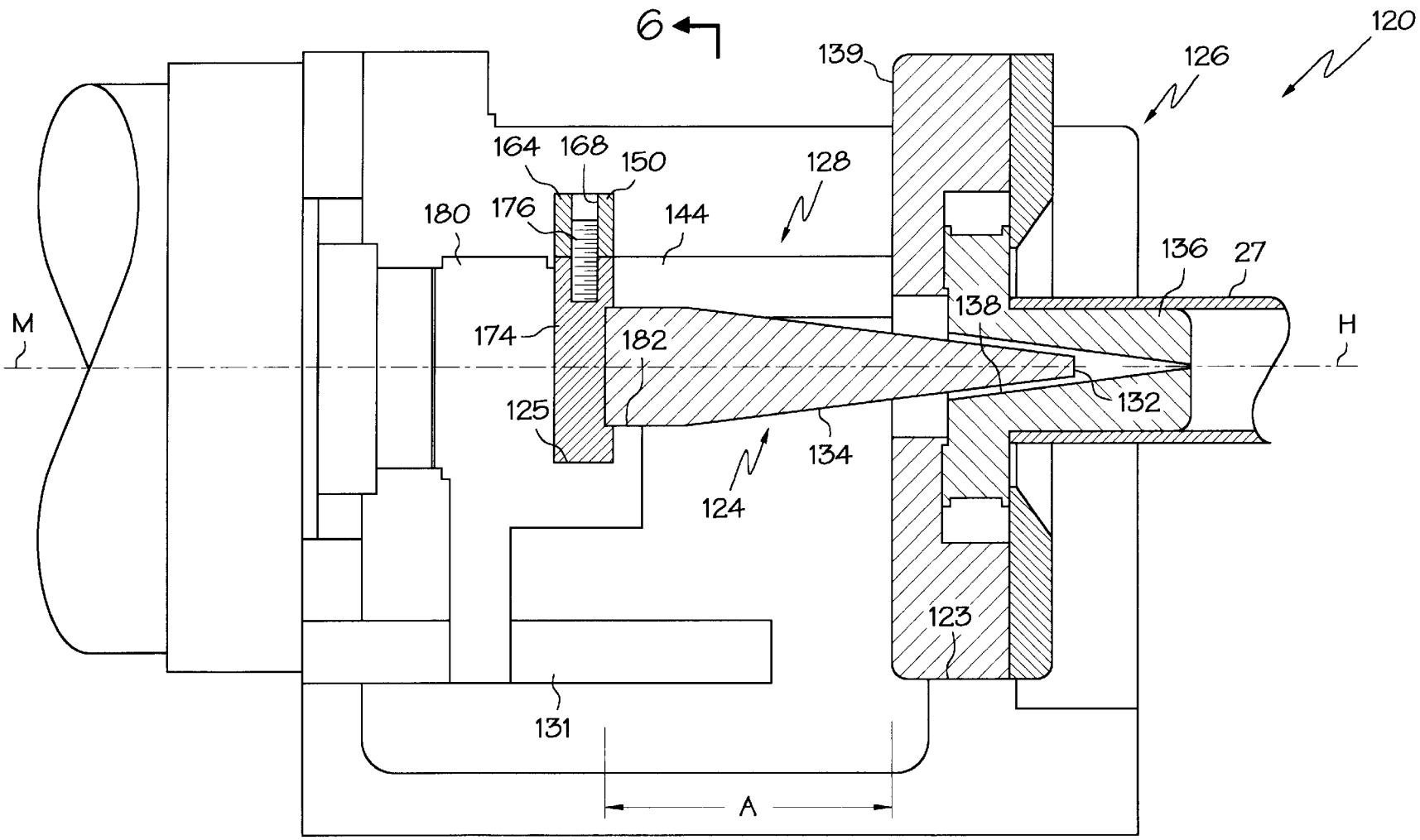
FIG. 5 is a partial cross-sectional side view of another embodiment of an improved machine tool assembly of the present invention, wherein the stationary body is adapted to only expand a work piece and only the machine tool assembly is shown in cross hatch for clarity.
Figure 6:
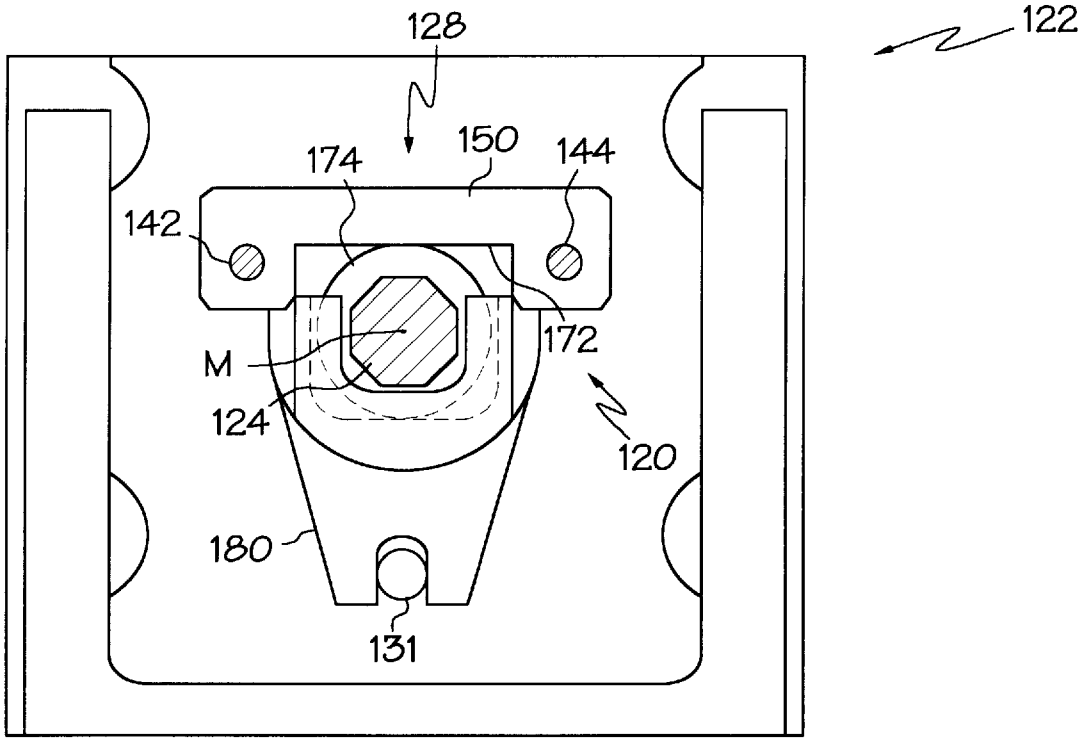
FIG. 6 is a partial cross-sectional front view of the machine tool assembly of FIG. 5, taken along line 6—6 thereof and wherein only the machine tool assembly is shown in cross hatch for clarity.

While it is preferred that a housing assembly comprises a set of radially expandable fingers and a set of radially reducing jaws for both expanding and reducing a work piece, it is contemplated that an integral machine tool assembly of the present invention can also comprise a housing assembly 126 having only a single set of radially movable fingers 136 for expanding a work piece, as shown in FIGS. 5 and 6. The interconnecting structure 128 of machine tool assembly 120 preferably comprises first and second rods 142 and 144 and a rod holder 150 which is connected to a mandrel adapter 174, as previously discussed. The mandrel adapter 174 is connected to a translating body in the form of a mandrel 124 such that the interconnecting structure 128 integrally joins the mandrel 124 and the housing assembly 126. While the mandrel 124 and interconnecting structure 128 of the machine tool assembly 120 are substantially the same as corresponding structures of the machine tool assembly 20, the tool holder 180 of a conventional sizing machine 122 adapted to accommodate the housing assembly 126 typically has a tool holder rod 131 disposed below the mandrel 124.

Figure 7:
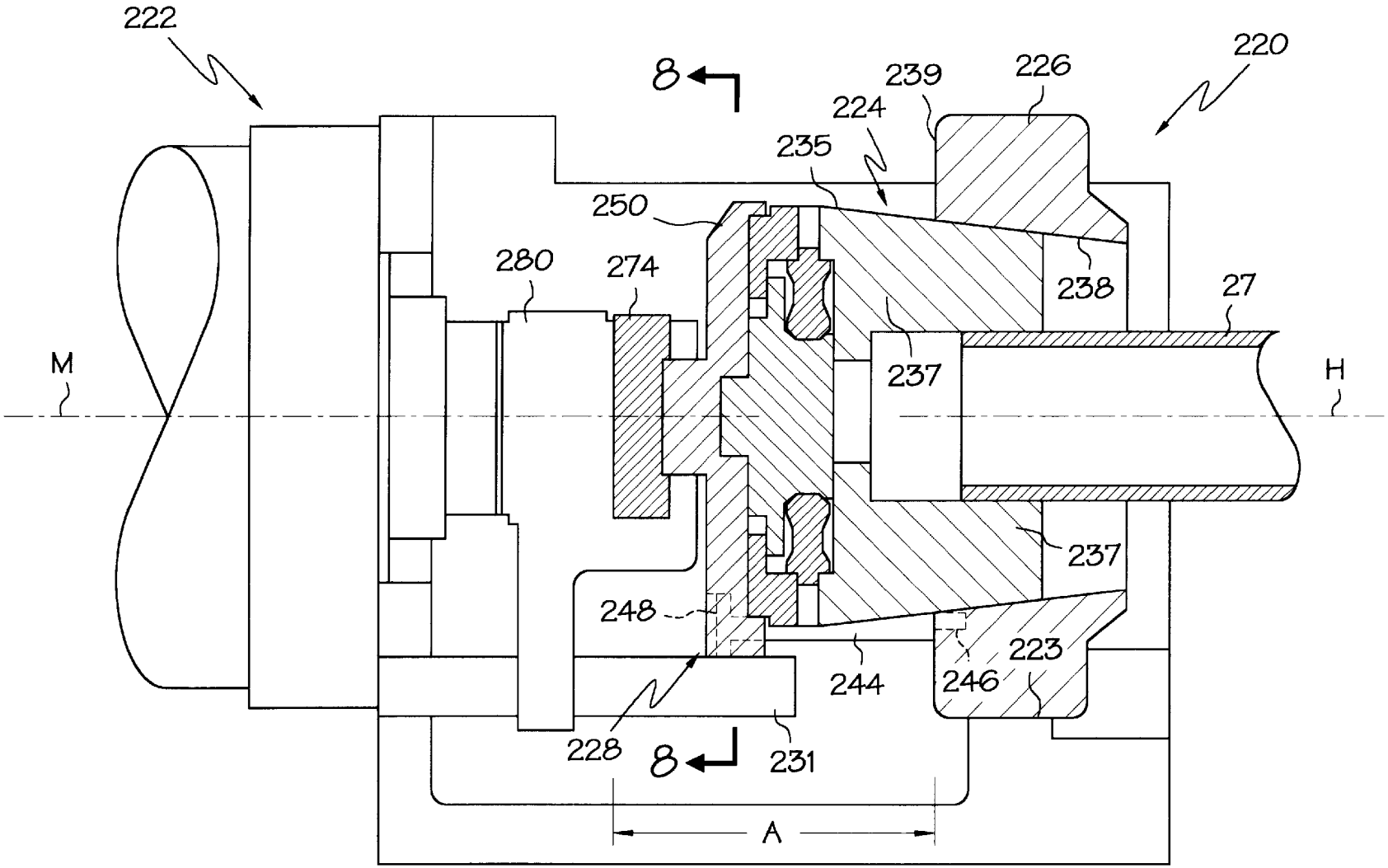
FIG. 7 is a partial cross-sectional side view of another embodiment of an improved machine tool assembly of the present invention, wherein the stationary body is adapted to only reduce a work piece and only the machine tool assembly is shown in cross hatch for clarity.
Figure 8:
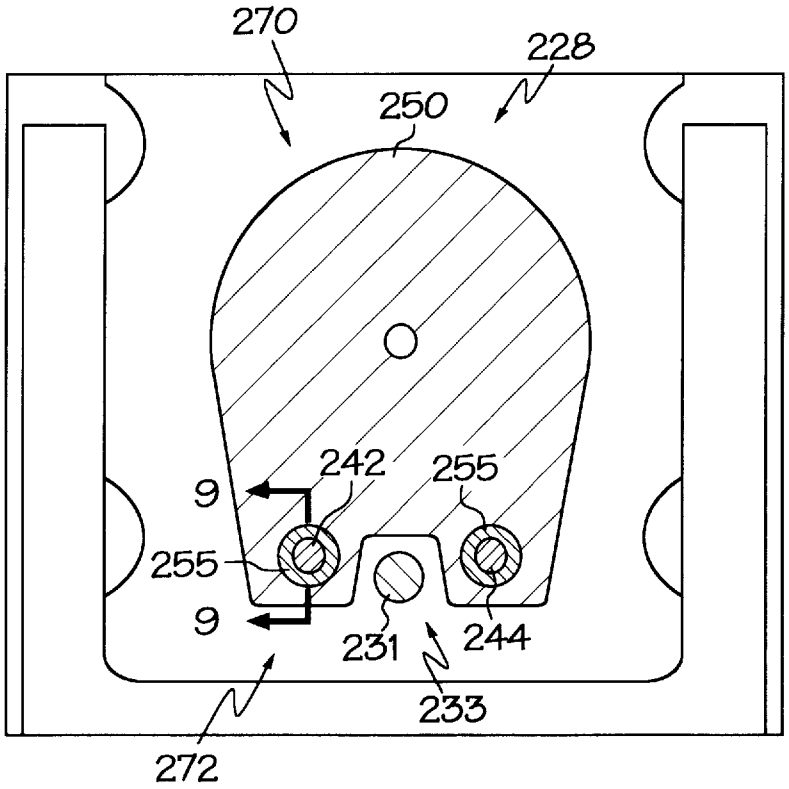
FIG. 8 is a partial cross-sectional front view of the machine tool assembly of FIG. 7, taken along line 8—8 thereof and wherein only the machine tool assembly and tool holder rod are shown in cross hatch for clarity.

Similarly, FIGS. 7 and 8 illustrate another preferred embodiment of a machine tool assembly of the present invention for use with a sizing machine 222 and adapted to only reduce a work piece 27. The stationary body is provided in the form of a ring 226 having a tapered inner surface 238. The translating body is provided in the form of a jaw assembly 224 having a plurality of radially movable jaws 237, each jaw 237 having a tapered outer surface 235 which cooperates with the tapered inner surface 238 of the ring 226 so that the jaws 237 of the jaw assembly 224 will move radially inwardly to reduce and shape the work piece 27 as the jaw assembly 224 is translated toward the ring 226.

The interconnecting structure 228 of the integral machine tool 220 preferably comprises a first rod 242 (FIG. 8), second rod (FIGS. 7 and 8), rod holder 250, and jaw adapter 274. As best seen in FIG. 8, the rod holder 250 preferably has a generally rounded top portion 270 and a generally flat bottom portion 272, the first and second rods 242 and 244 being disposed on either side of the tool holder rod. 231 and adjacent the bottom portion. Preferably, the rod holder 250 has a channel 233 through which the tool holder rod 231 passes with the tool holder 280 of the sizing machine 222 slidably engaging rod 231 such that the rod 231 supports the tool holder and maintains it in an upright position, as best seen in FIG. 7.

Figure 9:
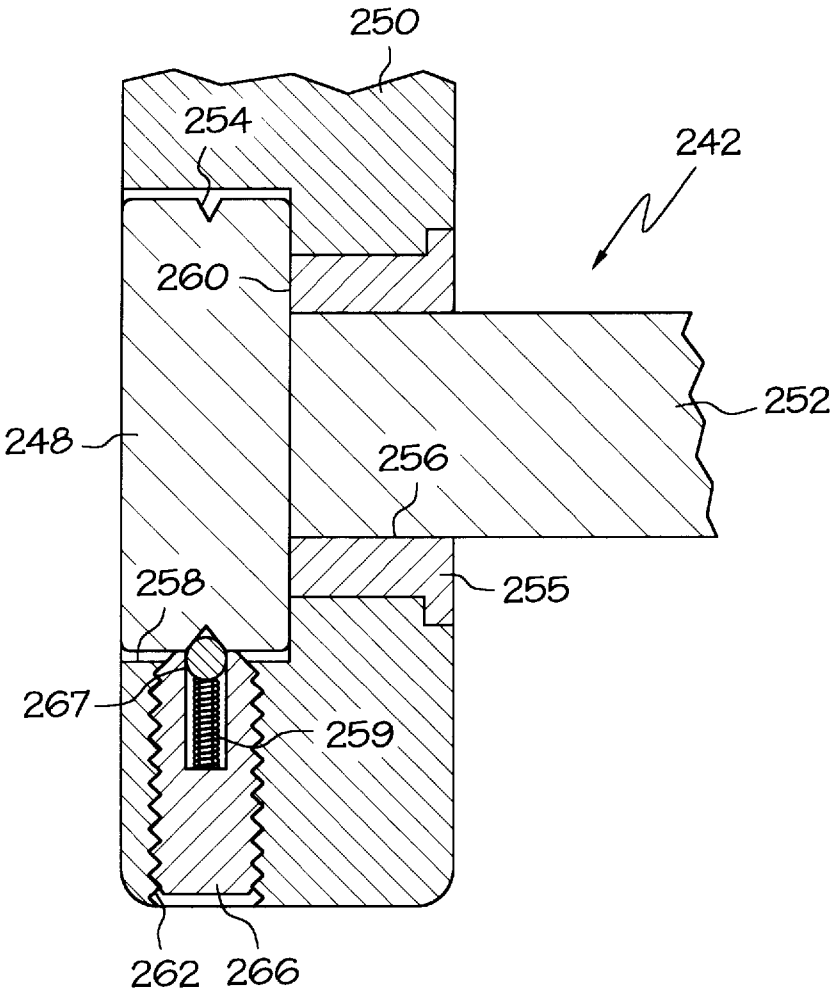
FIG. 9 is a partial cross-sectional side view of a rod holder and rod of the machine tool assembly of FIG. 8, taken along line 9—9 thereof.

Also, as shown in FIG. 7, each guide rod has a threaded end 246 which engages the rear face 239 of the ring 226. Each rod also has a free end 248 disposed opposite the threaded end 246 with a groove 250 disposed thereon, as shown in FIG. 9. The rod holder 250 has a bushing 255 with a bushing hole 256 for slidably receiving the rod body 252 of each rod, as previously described, and also has an end bore 258 for slidably receiving the free end 248 of each rod. A threaded pin hole 262 with a pin 266 having an alignment ball 267 biased by a spring 259 disposed therein preferably engages the groove 254 when the jaw assembly 224 is fully retracted from the ring 226 (i.e., when the free end 248 engages end wall 260). The engagement of the alignment ball 267 with the groove 254 of the free end 248 of each rod provides an axial alignment member which maintains a predetermined distance A between the jaw assembly 224 and tapered ring 226 during handling, shipping, installation and/or removal of the machine tool 220 from the sizing machine 222. The arrangement of the first and second rods 242 and 244 in combination with the rod holder 250 also provides a radial and angular alignment member which prevents relative radial and angular movement between the jaw assembly 224 and the ring 226. In other words, the position of and interconnection of the guide rods resists relative angular movement between the jaw assembly 224 and the ring 226 while the fit between the outside diameters of the free end 248 and the rod body 252 with the inside diameters of the bores 256 and 258 of the rod holder 250 resists radial movement between the jaw assembly 224 and the ring 226. Preferably the pin 266 and groove 254 are positioned so that the predetermined distance A between the rear of the mandrel adapter 274 and the rear face 239 of the ring 226 is between about 4 and 6 inches, and, more preferably, about 5 inches so that the integral machine tool assembly 220 is interchangeable with conventional tube sizing machines as shown.

Figure 10:
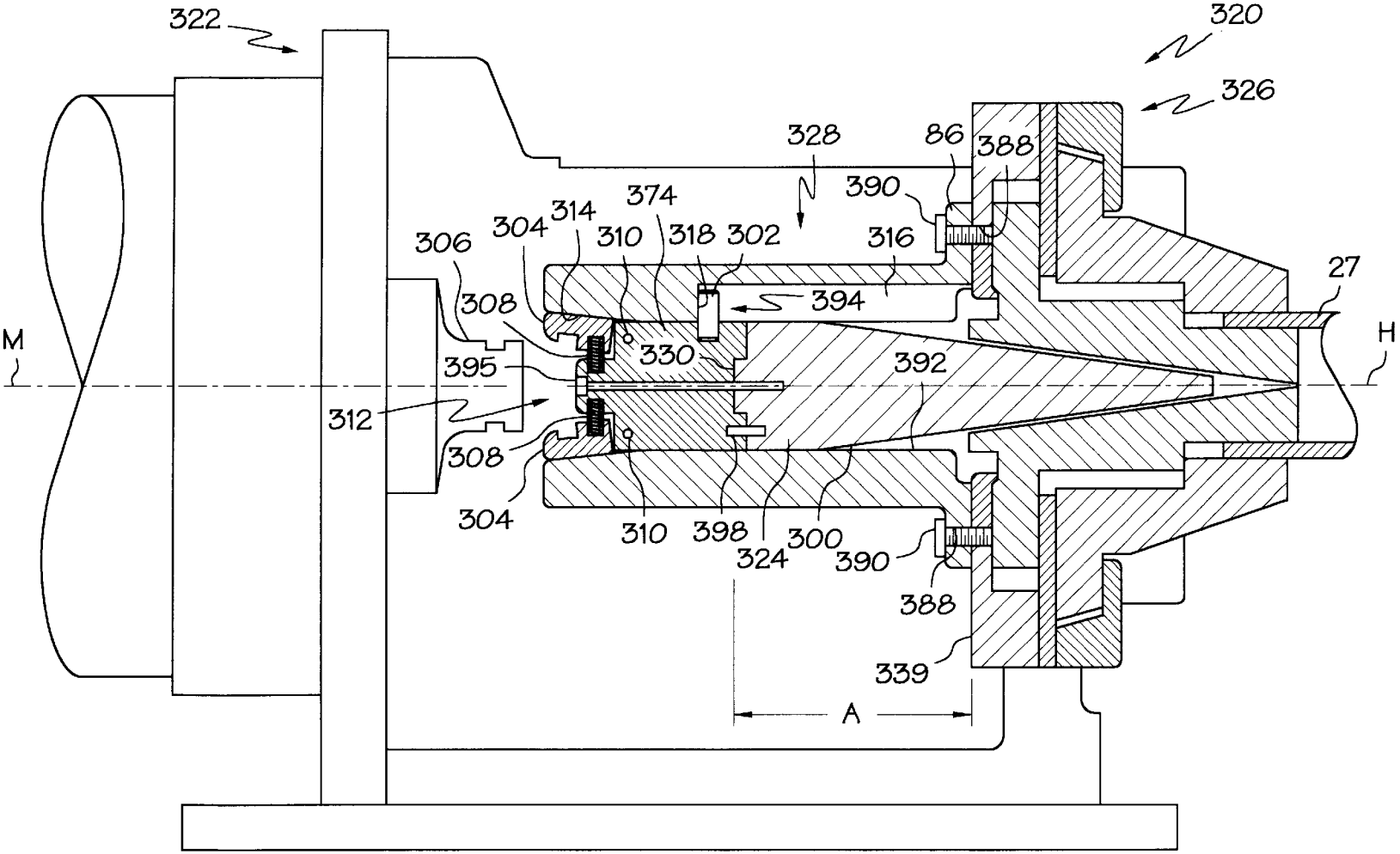
FIG. 10 is a partial cross-sectional side view of another embodiment of an improved machine tool assembly of the present invention, wherein the interconnecting structure comprises a tube having a radially extending flange and an engagement mechanism having radially biased arms, and wherein only the machine tool assembly is shown in cross hatch for clarity.

Referring now to FIG. 10, another preferred embodiment of the present invention is illustrated as an effectively integral machine tool 320. The machine tool 320 preferably comprises a translating body in the form of a mandrel 324, a stationary body in the form of housing assembly 326, and an interconnecting structure 328. The mandrel 324 and the housing assembly 326 are substantially the same structures as previously discussed, for example, with respect to integral machine tool assembly 20. The interconnecting structure 328, however, comprises a tube 384 having a radially extending flange 386 with a plurality of flange bolt holes 388 disposed thereon. Bolts 390 are disposed within the flange bolt holes 388 and threadably engage the rear face 339 of the housing assembly 326, thereby joining the interconnecting structure 328 with the housing assembly 326.

The tube 384 has a passage 392 for slidably receiving the mandrel 324, the inside diameter of which is appropriately sized relative to the outside diameter of the mandrel so that the mandrel 324 can easily translate within the passage 392 without significant radial movement (i.e., the passage thereby acting as a radial alignment member). The passage 392 also functions to guide the mandrel 324 during its axial extension and retraction strokes. Disposed adjacent to and in communication with the passage 392 is a slot 394 which extends axially from adjacent the rear face 339. The length of the slot 394 determines the mandrel stroke with the predetermined distance A between the first end 330 and the rear face 339 preferably being between about 3.5 and about 5.5 inches, and, more preferably about 4.5 inch so that the integral machine tool 320 can be interchangeable with existing sizing machines.

A mandrel adapter 374 is connected to the first end 330 of the mandrel 324 by a mandrel bolt 395 which is illustrated as passing through the mandrel adapter 374 and threadably engaging the first end 330. An anti-rotation pin 398 can also be provided at the interface between the first end 330 and the mandrel adapter 374 to prevent relative rotation between the mandrel 324 and the mandrel adapter 374. Preferably, an alignment pin 302 is disposed within the mandrel 324 and extends into the slot 394 such that the alignment pin and the slot together operate to provide an angular alignment member. In other words, the pin 302 will encounter one of the slot walls (e.g., 316) if the mandrel 324 begins to rotate about the longitudinal axis M, thereby effectively preventing the rotation of the mandrel 324.

The mandrel adapter 374 preferably farther comprises an engagement mechanism for releasably engaging an actuator 306 of the sizing machine 322. Providing the integral machine tool assembly 320 with a releasable engagement mechanism effectively eliminates the need for a sizing machine with a tool holder, thereby simplifying the structure of conventional sizing machines 322. The engagement mechanism can be provided in the form of engagement arms 304 which are disposed opposite the first end 330 and preferably biased radially outwardly by springs 308, as shown in FIG. 10. Each engagement arm 304 preferably pivots about a pivot pin 310 such that the radially outwardly biased engagement arms 104 are normally disengaged from and do not otherwise interfere with the movement of the actuator 306 when the mandrel 324 is in its fully retracted position. The passage opening 312, communicating with the passage 392 preferably has an angled counter sink or flare 314 or is otherwise tapered adjacent the passage opening 312 so that the radially biased engagement arms 304 can easily transition from an open position as shown in FIG. 10 to a closed position (not shown) thereby engaging the actuator 306 as the activator 306 translates the mandrel 324 and mandrel adapter 324 toward the housing assembly 326.

When the mandrel 324 is fully retracted as shown in FIG. 10, the radially biased engagement arms 304, in cooperation with the alignment pin 302, together provide an axial alignment member which prevents substantial inadvertent axial movement of the mandrel 324 along the longitudinal axis M during installation and/or removal of the machine tool assembly 320 from the sizing machine 322. In other words, the radially biased engagement arms 304 resist translation of the mandrel 324 toward the housing assembly 326 by their biased frictional engagement with the flare 314 while the alignment pin 302 and the slot face 318 effectively prevent further translation of the mandrel 324 in a direction away from the housing assembly 26.

In addition, the passage 392 functions as a radial alignment member preventing radial movement of the mandrel 324 during installation and/or removal of the integral machine tool 320 from the sizing machine 322 as well as during operation thereof. Particularly, the inside diameter of the passage 392 is sized such that the mandrel adapter 374 can easily slidably translate within the passage 392 but is not free to move substantially in a direction perpendicular to the longitudinal axis M.

Figure 11:
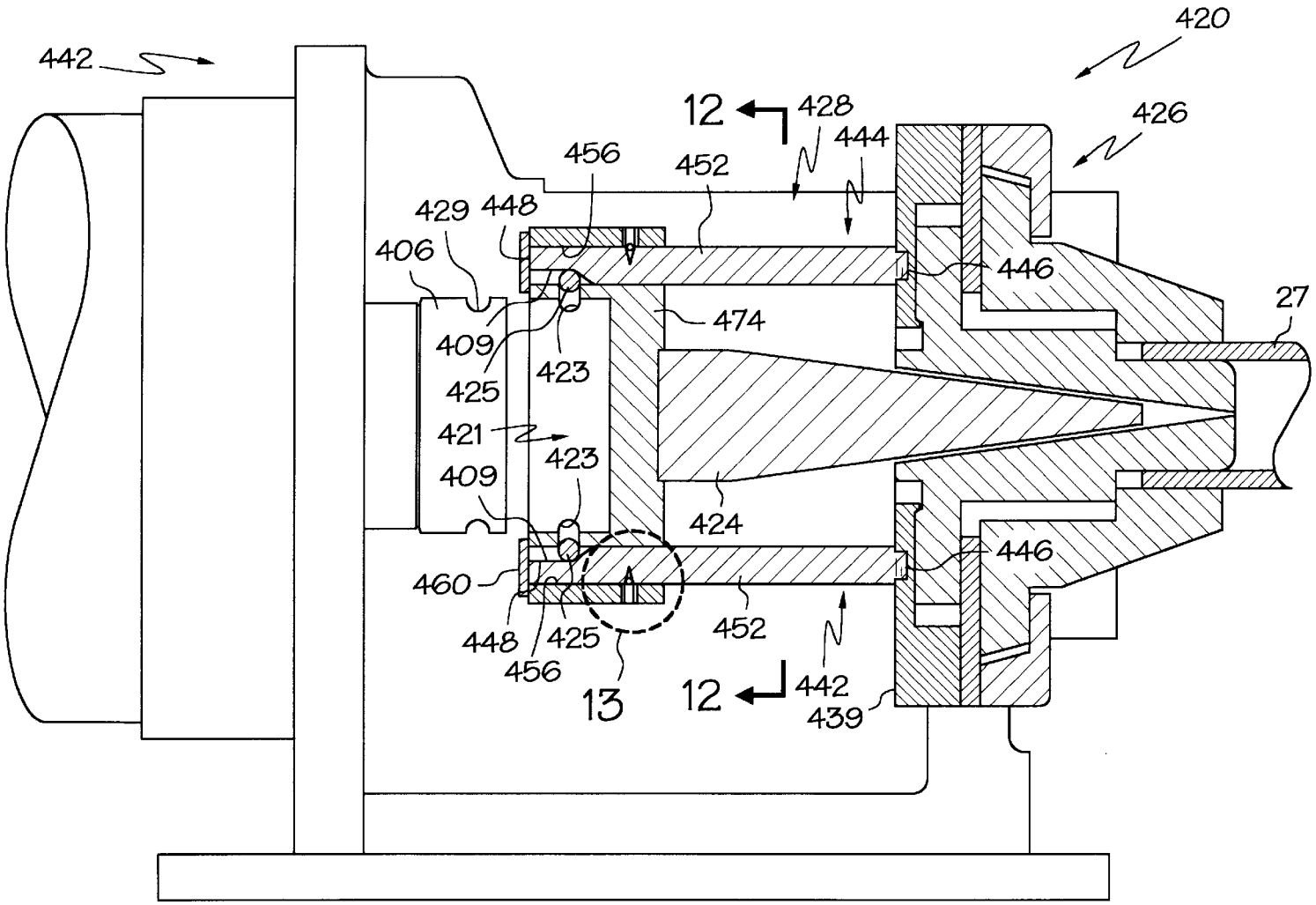
FIG. 11 is a partial cross-sectional side view of another embodiment of an improved machine tool assembly of the present invention, wherein the interconnecting structure comprises an engagement mechanism having a locking ball and groove, and wherein only the machine tool assembly is shown in cross hatch for clarity.
Figure 12:
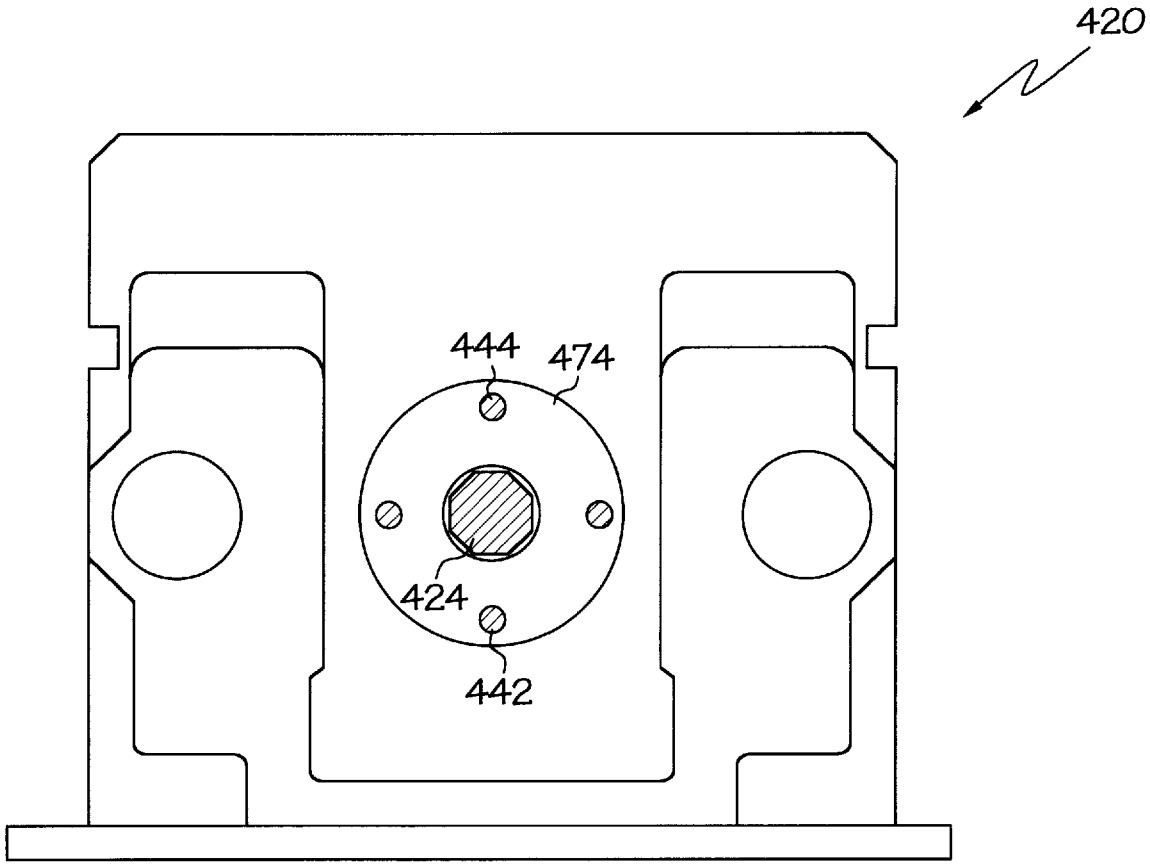
FIG. 12 is partial cross-sectional front view of the machine tool assembly of FIG. 11, taken along line 12—12 thereof and wherein only the machine tool assembly is shown in cross hatch for clarity.

Another embodiment of the present invention is illustrated in FIGS. 11 and 12, wherein an integral machine tool assembly 420 having a mandrel 424, a housing assembly 426, and an interconnecting structure 428 is provided. The mandrel 424 and housing assembly 426 are shown by way of example in forms as previously discussed, while the interconnecting structure 428 comprises a substantially cylindrical mandrel adapter 474 having an actuator bore 421 for receiving an actuator 406 and, preferably, four equally spaced guide rods (e.g., 442 and 444 as shown in FIG. 12). The mandrel adapter 474 can be connected to the mandrel 424 by means known in the art, such as by mechanical fasteners, welding, adhesives, interference fit or the like.

As shown in FIG. 11, each rod has a threaded end 446 for threadably engaging the rear face 439 of housing assembly 426 and a rod body 452 which slidably engages the rod bore 456, thereby functioning as a radial alignment member. In this arrangement, the inside diameter of the rod bore 456 appropriately corresponds with the outside diameter of the rod body 452 such that the rod body 452 can slidably translate within the rod bore 456 but cannot move substantially in a direction perpendicular to the longitudinal axis M, as previously discussed.

Disposed opposite the threaded end 446 on each rod is a depression 409 which is adjacent a ball passage 423 when the mandrel 424 is fully retracted from the housing assembly 426, the ball passage 423 being disposed on the mandrel adapter 474. The ball passage 423 is disposed between and in communication with a rod bore 456 and an actuator bore 421 such that a locking ball 425 disposed within the ball passage 423 can engage the depression 409 disposed on each guide rod adjacent its free end 448 when the mandrel 424 is fully retracted. The depression 409 is preferably tapered radially inwardly in a direction toward the threaded end 446 so that the locking ball 425 can easily transition between the depression 409 and the outer surface of the rod body 452 as the mandrel adapter 474 translates toward the housing assembly 426. The locking ball 425, the actuator race 429, and depression 409 cooperate as an engagement mechanism to interconnect the mandrel adapter 474 and the actuator 406 during the mandrel extension and retraction strokes. In addition, the actuator 406 easily disconnects from the machine tool assembly 420 at the completion of the mandrel retraction stroke so that the actuator can be moved clear of it, as shown in FIG. 11, thereby facilitating easy removal of the machine tool assembly 420 from the sizing machine 422. The above-described engagement function is accomplished as the mandrel adapter (and hence also the mandrel 424) 474 translates under the applied force of the actuator 406 and the locking ball 425 transitions from contacting the depression 409 to contacting the outer surface of the rod body 452. Particularly, when the locking ball 425 contacts the rod outer surface, the locking ball 425 preferably protrudes into the adapter bore 421 such that it can engage the actuator race 429 thereby locking together the actuator 406 and the mandrel adapter 474 such that withdrawal of the actuator 406 in a direction away from the housing assembly 426 will also retract the mandrel adapter 474 and the mandrel 424.

The mandrel retraction stroke is complete when the mandrel adapter 474 engages end ring 460, thereby providing a positive termination and preventing further retraction of the mandrel 424. At this position, the locking ball 425 can translate radially outwardly into the depression 409 so that the actuator 406 can be further retracted clear of the actuator bore 421. Once disconnected from the actuator 406, the machine tool assembly 422 of the present invention can be easily and quickly removed from the sizing machine 422 for interchange, such as by manual removal or automatic handling such as by an automatic tool charger, pivot arm, hydraulic cylinder or pick and place devices.

Figure 13:
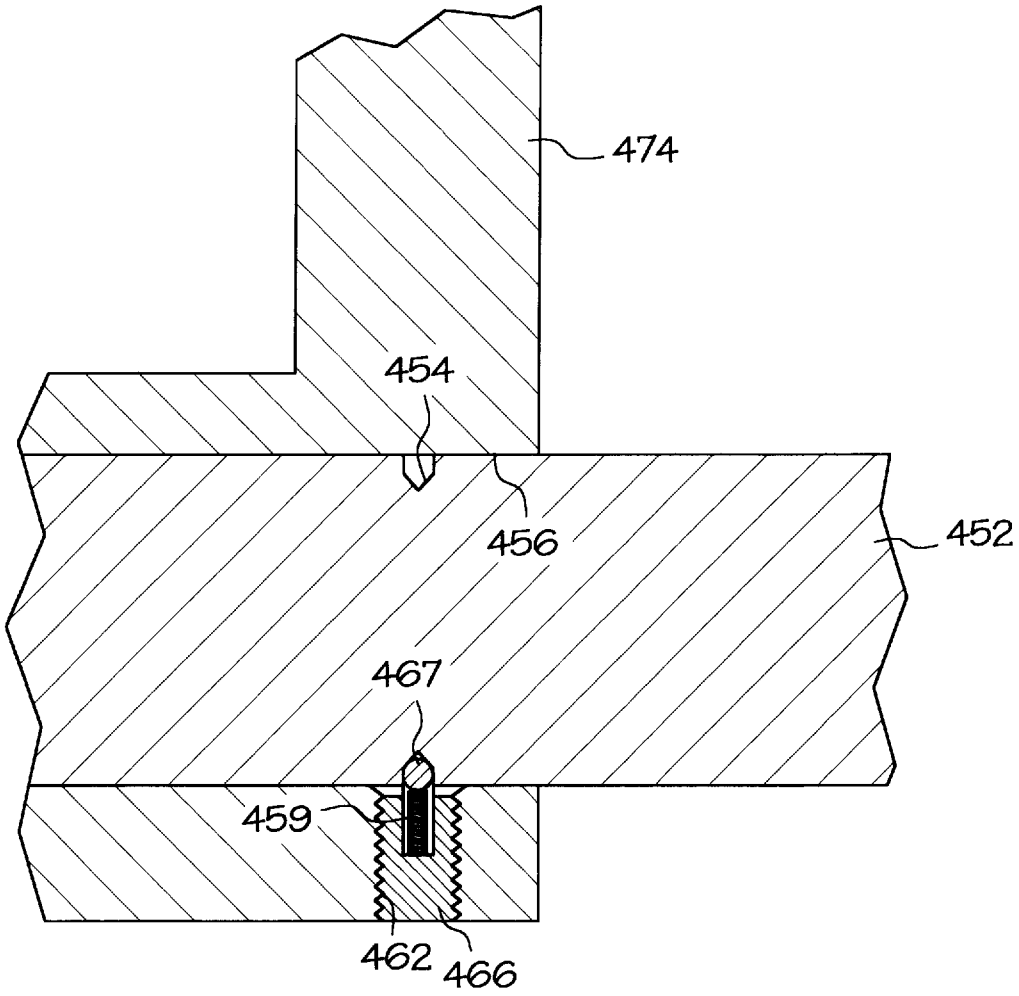
FIG. 13 is a partial cross-sectional side view of a rod holder and rod of the machine tool assembly of FIG. 12, taken along line 13—13 thereof.

When the mandrel 424 is fully retracted, an axial alignment member preferably in the form of a pin having an alignment ball biased by a spring 459 is provided to resist inadvertent axial movement of the mandrel 424. Particularly, and as shown in FIG. 13, a threaded pin hole 462 is provided in the mandrel adapter 474 so that an alignment ball 467 biased by a spring 459 of a threaded pin 466 can engage a groove 454 disposed on the guide rods, such as is shown with respect to rod 452. As previously discussed, this arrangement provides an axial alignment member which resists inadvertent movement of the mandrel 424 such that a predetermined distance A can be maintained during installation and/or removal of the integral machine tool 420 from the sizing machine 422. Preferably, the distance A is between about 3.5 and about 5.5 inches, and, more preferably about 4.5 inch so that the integral machine tool assembly 420 is interchangeable with existing sizing machines.

Figure 14:
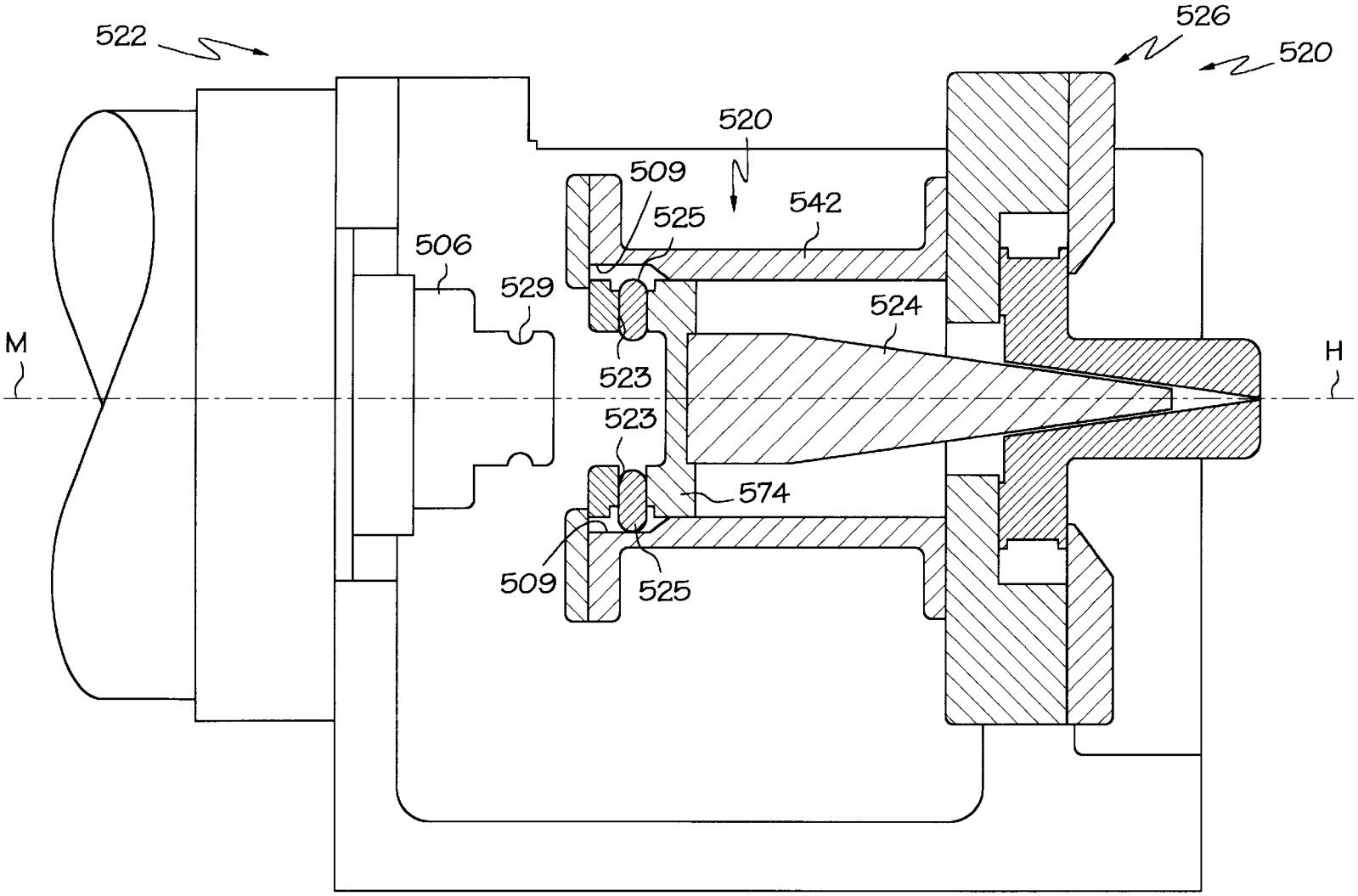
FIG. 14 is a partial cross-sectional side view of another embodiment of an improved machine tool assembly of the present invention, wherein the interconnecting structure comprises a tube and an engagement mechanism having a locking ball and groove, and wherein only the machine tool assembly is shown in cross hatch for clarity.

While the above-described arrangement for interconnecting structure 428 is preferred, other structures or configurations are contemplated and can be likewise substituted. For instance, FIG. 14 illustrates an alternative embodiment of an interconnecting structure where a tube-shaped guide 542 of interconnecting structure 520 slidably receives the mandrel adapter 574, thereby effectively replacing the guide rods of the interconnecting structure 428 of FIGS. 12 and 13. Alternatively, other arrangements for the axial alignment member of interconnecting structure 428 can also be provided. For example, the spring-biased alignment ball can be incorporated into the guide rods so that the ball engages a groove disposed on rod holder. In addition, it is contemplated that the locking balls (as well as the spring-biased alignment balls) can be provided with other rounded cross-sectional shapes such as oval, elliptical, or the like.

Figure 15:
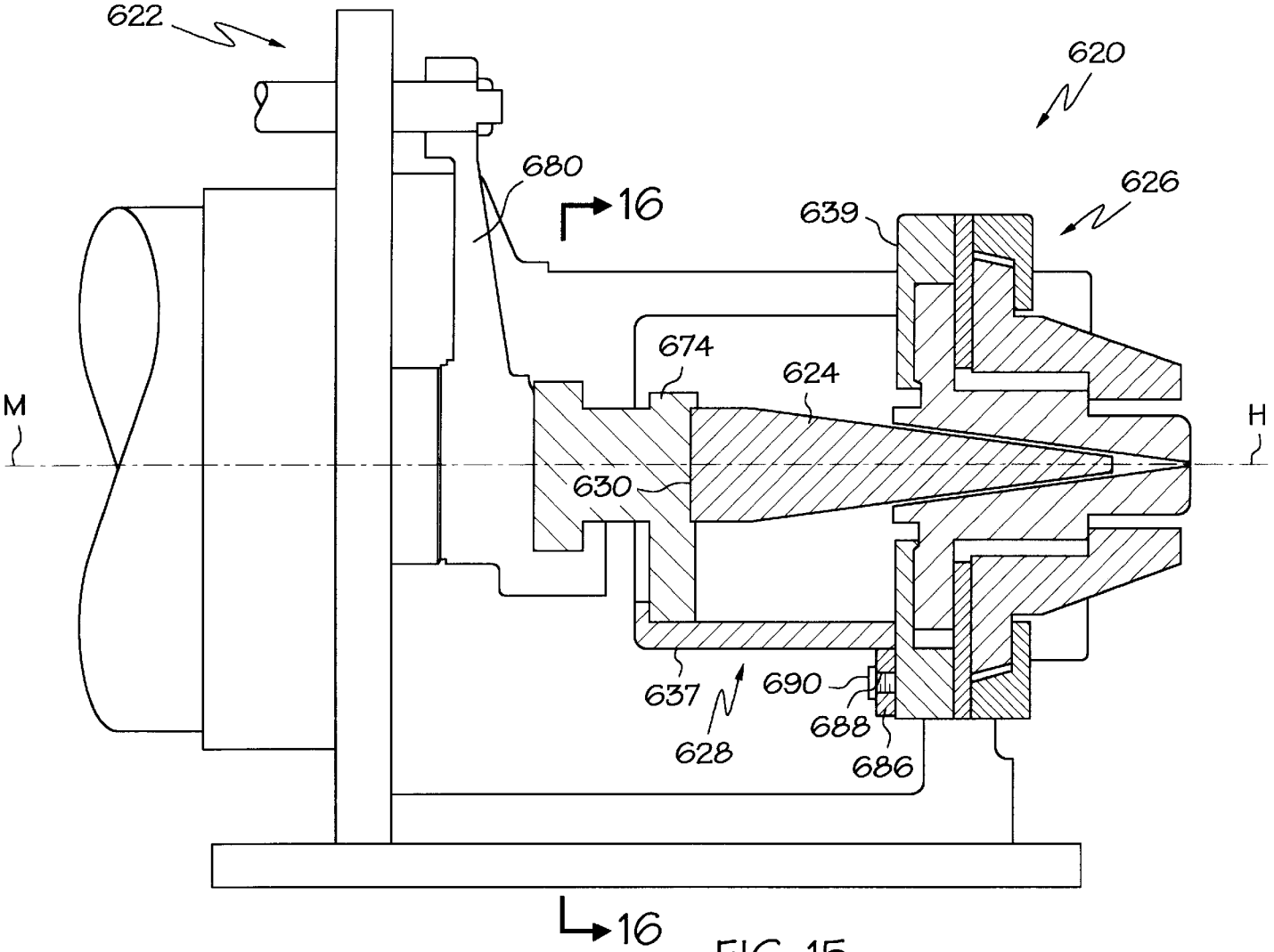
FIG. 15 is a cross-sectional side view of a yet another embodiment of a machine tool assembly of the present invention comprising a substantially U-shaped interconnecting structure, wherein only the machine tool assembly is shown in cross hatch for clarity.
Figure 16:
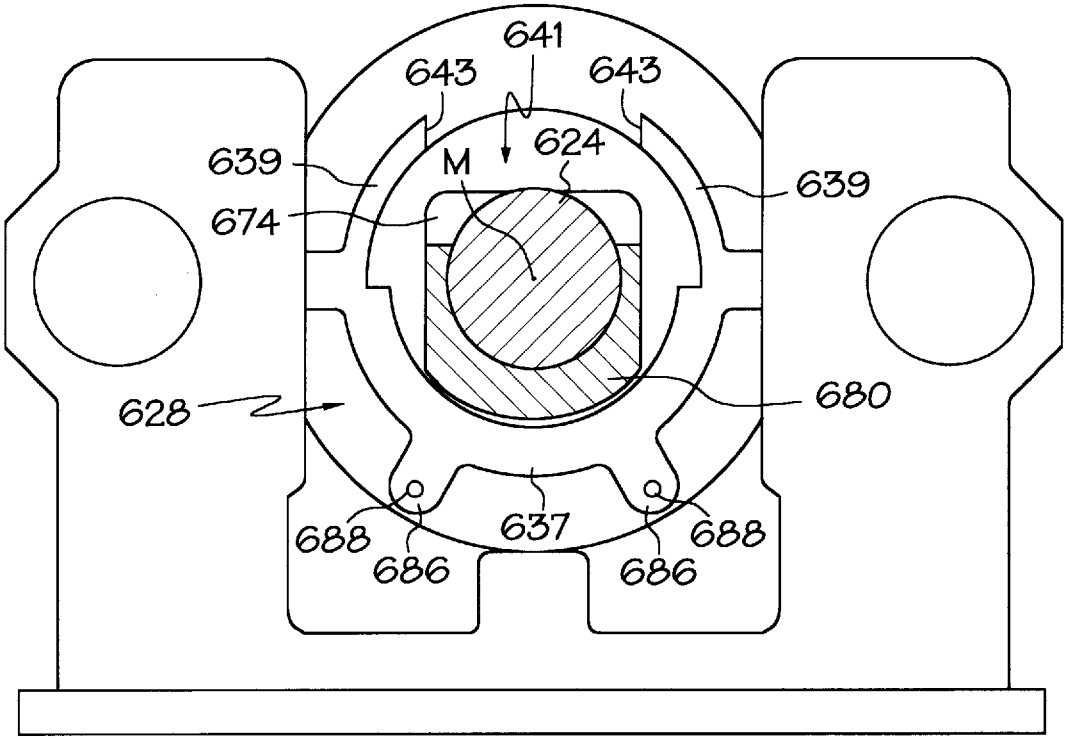
FIG. 16 is a cross-sectional front view of the integral machine tool assembly of FIG. 15, taken along line 16—16 thereof and wherein only the machine tool assembly is shown in cross hatch for clarity.

A still further embodiment of integral machine tool of the present invention is shown in FIGS. 15 and 16. Integral machine tool assembly 620 preferably comprises a translating body in the form of a mandrel 624, a stationary body in the form of a housing assembly 626, and a substantially U-shaped interconnecting structure 628 having a plurality of radially extending flanges 686, each flange having a flange bolt hole 688 disposed therein. In this embodiment, bolts 690 threadably engage the rear face 639 thereby attaching the interconnecting structure 628 to the housing assembly 626.

The interconnecting structure 628 has a partially cylindrical (i.e., substantially hemispherical in cross section) base 637 which supports the mandrel adapter 674 and, hence also mandrel 624, when the machine tool 620 is handled, shipped, installed and/or removed from the sizing machine 622 as well as during operation thereof. As best seen in FIG. 16, two curving side walls 639, which are relatively more thin than the thickness of the partially cylindrical base 637, extend upwardly from the ends of the base 637 such that an interconnecting structure opening 641 is formed between the side wall ends 643. The structure opening 641 is of sufficient width so that the tool holder 680 of the sizing machine 622 can be unobstructively accommodated between the side walls 639 as it advances the mandrel 624.

As seen best in FIG. 15, the mandrel adapter 674 is preferably joined, as is known in the art, to the first end 630 of the mandrel 624 so as to fixedly connect the mandrel adapter 674 to the mandrel. The mandrel adapter 674 is adapted to slidably engage the pocket 678 of the tool holder 680 and also slidably engages and is supported by the base 637 during installation and/or removal of the integral machine tool 620 from the sizing machine 622 as well as during operation thereof.

The operation of an integral machine tool assembly of the present invention generally encompasses one or all the following steps: assembling the plurality of parts and subassemblies of at least the translating body (e.g., a mandrel or jaw assembly) and stationary body (e.g., a housing assembly, or tapered ring) together with their interconnecting structure, loading the pre-assembled integral machine tool assembly of the present invention into a sizing machine, moving the translating body toward the stationary body to size and shape a work piece, retracting the translating body after completion of the sizing operation, and removal of the integral machine tool assembly from the sizing machine when it is desired to interchange the machine tool assembly and/or otherwise accommodate the sizing of a tube requiring a different translating and stationary bodies. After the stationary body is fully retracted, the integral machine tool assembly can be removed from the sizing machine either manually or mechanically, such as by a hydraulic cylinder and arm arrangement or the like preferably be engaging a single lifting structure attached to the stationary body. Because the translating body and the stationary body are joined by an interconnecting structure, handling, installation, shipping, interchange and/or removal of integral machine tool assembly is advantageously quick and simplified when it desired to reconfigure the sizing machine to accommodate tubes of varying sizes, perform further operations on work pieces already worked, maintain the equipment and/or otherwise interchange the tooling.

Having shown and described the preferred embodiments of the present invention. Further adaptions of the integral machine tool arrangement described herein can be accomplished by appropriate modification by one of ordinary skill in the art without departing from the scope of the present invention. Several of such potential modifications have been mentioned, and others will be apparent to those skilled in the art. The particular embodiments shown and described herein are intended only as preferred exemplary arrangements of the various structures and functions of the present invention. Accordingly, the scope of the present invention should be considered in terms of the following claims and is understood not be limited to the details of structure and operation shown and described in the specification and drawings.

What is claimed is:

1. An improved machine tool assembly for use in a machine for working a work piece, comprising:

a first body having a longitudinal axis, said first body being movable in a direction along its longitudinal axis;

a second body for engaging said first body during use to deform a work piece, said second body having a longitudinal axis, said longitudinal axes of said bodies being substantially coaxial;

an interconnecting structure joining said bodies in an effectively integral manner, at least one of said first body, said second body and said interconnecting structure being adapted to engage a machine in use;

each of said bodies having an angular position about its respective longitudinal axis and said interconnecting structure having an angular alignment member for maintaining said angular positions of said bodies relative to each other;

said interconnecting structure and said bodies being adapted to be simultaneously separated as a unit from the machine; and wherein said body is adapted to be stationary along its longitudinal axis during use.

2. The machine tool assembly of claim 1, wherein said first body is in the form of a mandrel and said second body has a plurality of radially movable fingers for deforming said work piece.

3. The machine tool assembly of claim 1, wherein said first body has a plurality of radially movable jaws and said second body is provided in the form of a ring.

4. The machine tool assembly of claim 1, wherein said angular alignment member comprises a slot and a pin slidably disposed within said slot.

5. The machine tool assembly of claim 1, wherein said angular alignment member comprises a rod and a bore, said rod being slidably disposed within said bore.

6. The machine tool assembly of claim 1, wherein said interconnecting structure further comprises an axial alignment member which resists axial movement of said first body along its longitudinal axis.

7. The machine tool assembly of claim 6, wherein said axial alignment member comprises a groove and an alignment ball for engaging said groove.

8. An improved machine tool assembly for use in a machine for working a work piece, comprising:

a first body having a longitudinal axis, said first body being movable in a direction along its longitudinal axis;

a second body for engaging said first body during use to deform a work piece, said second body having a longitudinal axis, said longitudinal axes of said bodies being substantially coaxial;

each of said bodies having a predetermined angular position relative to its respective longitudinal axis;

an interconnecting structure joining said bodies;

at least one of said first body, said second body, and said interconnecting structure being adapted to engage a machine during use;

said interconnecting structure having an axial alignment member for resisting axial movement of said first body along its longitudinal axis, and an angular alignment member for maintaining said predetermined angular positions of said bodies; and said interconnecting structure and said bodies being adapted to be simultaneously separated as a unit from the machine; and wherein said second body is adapted to be stationary along its longitudinal axis during use.

9. The integral machine tool assembly of claim 8, wherein said first body further comprises a first end, and said second body further comprises a rear face, said axial alignment member maintaining a distance between said first end and said rear face of between about 4.5 inches and about 6.5 inches when said first body is fully retracted from said second body.

10. The integral machine tool assembly of claim 8, wherein said angular alignment member comprises a bore and a rod slidably received within said bore.

11. The integral machine tool assembly of claim 8, wherein said interconnecting structure further comprises:

a tube having a passage and a radially extending flange for connecting said tube to said second body, said passage of said tube slidably receiving said first body;

a pin disposed within said first body; and a slot disposed adjacent to and communicating with the passage, said pin slidably received within said slot, and said pin and slot maintaining said predetermined angular positions of said bodies.

12. A machine for working a work piece, comprising:

an integral machine tool assembly having a first body with a longitudinal axis, a second body having a longitudinal axis, said longitudinal axes of said bodies being substantially coaxial, said bodies cooperating during use to deform a work piece, and an interconnecting structure joining said bodies in an effectively integral manner;

each of said bodies having an angular position about its respective longitudinal axis and said interconnecting structure having an angular alignment member for maintaining said angular positions of said bodies relative to each other;

an actuator for moving said first body with respect to said second body;

at least one of said first body, said second body, and said interconnecting structure being adapted to engage said actuator;

said interconnecting structure and said bodies being adapted to be simultaneously separated as a unit from said actuators; and wherein said second body is adapted to be stationary along its longitudinal axis during use.

13. The integral machine tool assembly of claim 12, wherein said interconnecting structure and said bodies are simultaneously removable in a direction substantially perpendicular to said longitudinal axis of said first body.

14. The work piece tool system of claim 12, wherein said actuator moves said first body in a direction along its longitudinal axis.

15. The work piece tool system of claim 12, wherein said interconnecting structure further comprises an engagement mechanism for releasably engaging said actuator.

16. The work piece tool system of claim 15, wherein said engagement mechanism comprises a slidably locking ball.

17. The work piece tool system of claim 15, wherein said engagement mechanism comprises a plurality of radially biased arms for engaging said actuator.

18. The work piece tool system of claim 13, wherein said integral machine tool assembly is rotatable about said longitudinal axes.

19. The work piece sizing machine of claim 12, wherein said actuator is movable in a direction along said longitudinal axes.

20. An improved machine tool assembly for use in a machine for working a work piece, said machine having an actuator, comprising:

a first body having a longitudinal axis and being movable in a direction along its longitudinal axis;

a second body for engaging said first body during use to deform a work piece, said second body having a longitudinal axis, the longitudinal axes of said first and second bodies being substantially coaxial;

an interconnecting structure joining said bodies in an effectively integral manner, said interconnecting structure having a mechanism for releasably engaging said actuator;

at least one of said first body, said second body, and said interconnecting structure being adapted to engage a machine during use, and said interconnecting structure and said bodies being adapted to be simultaneously separated as a unit from the machine; and wherein said second body is adapted to be stationary along its longitudinal axis during use.

21. An improved machine tool assembly for use in work piece sizing and shaping machine applications, comprising:

a first body having a longitudinal axis, said body being movable in a direction along its longitudinal axis;

a second body for engaging said first body during use to deform a work piece, said second body having a longitudinal axis, said longitudinal axes of said bodies being substantially coaxial;

an interconnecting structure joining said bodies in an effectively integral manner so that said interconnecting structure and said bodies are simultaneously movable as a unit; and an axial alignment member which resists axial movement of said first body along its longitudinal axis, said axial alignment member comprising a groove and an alignment ball for engaging said groove.

22. A work piece sizing machine, comprising:

an integral machine tool assembly having a first body with a longitudinal axis, a second body having a longitudinal axis, the longitudinal axes of said bodies being substantially coaxial, said bodies cooperating during use to deform a work piece, and an interconnecting structure joining said bodies in an effectively integral manner so that said interconnecting structure and said bodies are simultaneously moveable as a unit;

an actuator for moving said first body with respect to said second body; and said interconnecting structure having an engagement mechanism for releasably engaging said actuator, said engagement mechanism comprising a plurality of radially biased arms.

23. A work piece sizing machine, comprising:

an integral machine tool assembly having a first body with a longitudinal axis, a second body having a longitudinal axis, the longitudinal axes of said bodies being substantially coaxial, said bodies cooperating during use to deform a work piece, and an interconnecting structure joining said bodies in an effectively integral manner so that said interconnecting structure and said bodies are simultaneously moveable as a unit;

an actuator for moving said first body with respect to said second body;

said interconnecting structure and said bodies being simultaneously removable in a direction substantially perpendicular to said longitudinal axis of said first body; and said integral machine tool assembly being rotatable about said longitudinal axes during use.

* * * * *

UNITED STATES PATENT AND TRADEMARK OFFICE

CERTIFICATE OF CORRECTION

| | | |
|---|---|---|
| PATENT NO. | : | 5,836,197 |
| DATED | : | November 17, 1998 |
| INVENTORS | : | Ralph E. McKee and James M. Burnett |

It is certified that error appears in the above-identified patent and that said Letters Patent is hereby corrected as shown below:

Claim 12, line 20, the last work of the penultimate paragraph should read "actuator".

Claim 21, line 12, after "and" and before"an alignment member which resists axial movement ...", there should be a paragraph space.

Claim 22, line 11, after "and" and before" said interconnecting structure having ...", there should be a paragraph space.

Signed and Sealed this

Thirtieth Day of March, 1999

*Attest:*

Q. TODD DICKINSON

*Attesting Officer*

*Acting Commissioner of Patents and Trademarks*